US011297412B2

(12) United States Patent
Zhu et al.

(10) Patent No.: US 11,297,412 B2
(45) Date of Patent: Apr. 5, 2022

(54) MINIATURE MOVING COIL LOUDSPEAKER WITH FERROFLUID

(71) Applicant: Bose Corporation, Framingham, MA (US)

(72) Inventors: Weidong Zhu, Waban, MA (US); Mark Andrew Hayner, Belmont, MA (US); Csaba Guthy, Hopkinton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/798,769

(22) Filed: Feb. 24, 2020

(65) Prior Publication Data

US 2021/0266659 A1 Aug. 26, 2021

(51) Int. Cl.

| | |
|---|---|
| ***H04R 25/00*** | (2006.01) |
| ***H04R 1/28*** | (2006.01) |
| ***H04R 7/24*** | (2006.01) |
| ***H04R 9/02*** | (2006.01) |
| ***H04R 9/06*** | (2006.01) |

(52) U.S. Cl.

CPC ..... *H04R 1/2826* (2013.01); *H04R 1/2811* (2013.01); *H04R 7/24* (2013.01); *H04R 9/025* (2013.01); *H04R 9/06* (2013.01); *H04R 2400/11* (2013.01)

(58) Field of Classification Search

CPC ..... H04R 1/2826; H04R 1/2811; H04R 7/24; H04R 9/025; H04R 9/06; H04R 2400/11

USPC ..... 381/370

See application file for complete search history.

(56) References Cited

U.S. PATENT DOCUMENTS

| | | | | |
|---|---|---|---|---|
| 5,243,662 | A | 9/1993 | Sogn et al. | |
| 5,461,677 | A * | 10/1995 | Raj | H04R 9/025 381/396 |
| 6,654,476 | B1 | 11/2003 | Guenther | |
| 9,628,903 | B2 | 4/2017 | Munro et al. | |
| 9,942,662 | B2 | 4/2018 | Sears et al. | |
| 2009/0180648 | A1 * | 7/2009 | Endo | H04R 9/046 381/184 |

(Continued)

FOREIGN PATENT DOCUMENTS

| | | | |
|---|---|---|---|
| EP | 3668113 | A1 | 6/2020 |
| WO | 2019031352 | A1 | 2/2019 |

OTHER PUBLICATIONS

Raj et al., "Long Term Reliability of Ferrofluids in Loudspeakers," AES 6th Regional Convention, Jun. 23-25, 1993, FerrorSound, Ferrofluidics Corporation, 12 pages.

(Continued)

*Primary Examiner* — Phylesha Dabney

(74) *Attorney, Agent, or Firm* — Hoffman Warnick LLC

(57) ABSTRACT

Various implementations include loudspeaker drivers. In some aspects, an electro-acoustic driver includes: a cup section; a core section at least partially housed in the cup section, the core section including: a primary magnet; and a coin adjacent to the primary magnet; a bobbin surrounding the core section between the cup section and the core section, where the bobbin and the core section define an inner magnetic gap; a coil surrounding the bobbin and a portion of the core section; and a ferrofluid located at the inner magnetic gap, where the driver has an outer diameter less than or equal to approximately 10 millimeters.

20 Claims, 7 Drawing Sheets

(56) References Cited

U.S. PATENT DOCUMENTS

| | | | | |
|---|---|---|---|---|
| 2017/0078800 | A1 | 3/2017 | Guthy et al. | |
| 2020/0021918 | A1 * | 1/2020 | Huang | H04R 7/18 |

OTHER PUBLICATIONS

Rosensweig et al., "Study of Audio Speakers Containing Ferrofluid," IOP Publishing Ltd, Journal of Physics: Condensed Matter, 2008, 5 pages.

Bottenberg et al., "The Dependence of Loudspeaker Design Parameters on the Properties of Magnetic Fluids", Journal of the Audio Engineering Society, Audio Engineering Society, New York, NY, vol. 28, No. 1/02, Jan. 1, 1980, pp. 17-24.

Invitiation to Pay Additional Fees and Partial Search Report for International Application No. PCT/US2021/018693, dated May 20, 2021, 18 pages.

* cited by examiner

MINIATURE MOVING COIL LOUDSPEAKER WITH FERROFLUID

TECHNICAL FIELD

This disclosure generally relates to loudspeakers. More particularly, the disclosure relates to miniature moving coil loudspeakers with ferrofluid for mitigating rocking.

BACKGROUND

Miniaturized moving coil loudspeakers can be beneficial in particular applications, for example, in wireless headphone systems such as in-ear headphones (also called "earbuds"). However, the size of these loudspeakers and their components makes them prone to rocking, for example, due to mechanical tolerances and assembly misalignment that are magnified at this small device scale.

SUMMARY

All examples and features mentioned below can be combined in any technically possible way.

Various implementations include loudspeaker drivers, in particular, drivers for miniature moving coil loudspeakers. The drivers can include a ferrofluid at the inner magnetic gap of the loudspeaker for enhancing performance.

In some particular aspects, an electro-acoustic driver includes: a cup section; a core section at least partially housed in the cup section, the core section including: a primary magnet; and a coin adjacent to the primary magnet; a bobbin surrounding the core section between the cup section and the core section, where the bobbin and the core section define an inner magnetic gap; a coil surrounding the bobbin and a portion of the core section; and a ferrofluid located at the inner magnetic gap, where the driver has an outer diameter less than or equal to approximately 10 millimeters.

In other particular aspects, an electro-acoustic driver includes: a cup section; a core section at least partially housed in the cup section, the core section including: a primary magnet; and a coin adjacent to the primary magnet; a bobbin surrounding the core section between the cup section and the core section, where the bobbin and the core section define an inner magnetic gap, where the inner magnetic gap spans an axial distance along the coil; a coil surrounding the bobbin and a portion of the core section; a ferrofluid located at the inner magnetic gap; and a cone coupled with the bobbin and overlying the core section, the cone for translating movement of the coil into an acoustic output at a front of the driver, where the ferrofluid fills the inner magnetic gap and is retained within the inner magnetic gap during operation of the driver.

In additional particular aspects, a wearable device includes: a microphone; a controller coupled with the microphone; and at least one electro-acoustic driver coupled with the controller for providing an audio output, the electro-acoustic driver including: a cup section; a core section at least partially housed in the cup section, the core section including: a primary magnet; and a coin adjacent to the primary magnet; a bobbin surrounding the core section between the cup section and the core section, where the bobbin and the core section define an inner magnetic gap; a coil surrounding the bobbin and a portion of the core section; and a ferrofluid located at the inner magnetic gap, where the electro-acoustic driver has an outer diameter less than or equal to approximately 10 millimeters.

Implementations may include one of the following features, or any combination thereof.

In some cases, the driver further includes a cone coupled with the bobbin and overlying the core section, the cone for translating movement of the coil into an acoustic output at a front of the driver.

In certain aspects, the ferrofluid mitigates rocking in the cone during operation of the driver at a frequency range including: approximately 200 hertz (Hz) to approximately 700 Hz.

In particular implementations, the ferrofluid adjusts the damping ratio of translational movement for the cone to approximately 0.5 to approximately 1.0 times critical damping during operation of the driver, and the ferrofluid dampens peak movement of the cone at mechanical resonance.

In some aspects, the ferrofluid includes a colloidal liquid, and, while the driver is at rest, the ferrofluid extends axially above and below the coin by a distance equal to approximately: a thickness of the coin multiplied by approximately 0 to approximately 1.

In certain cases, the ferrofluid weighs approximately 1-3 milligrams (mg).

In particular cases, a weight ratio of the coin to the ferrofluid is equal to approximately 2 to approximately 50.

In certain implementations, the coil translates along an axis during operation of the driver.

In some cases, the driver further includes a secondary magnet adjacent to the coin, where the coin is positioned between the primary magnet and the secondary magnet.

In particular aspects, the inner magnetic gap spans an axial distance along the coil, where the ferrofluid fills the inner magnetic gap and is retained within the inner magnetic gap during operation of the driver.

In certain cases, the coil and the cup section define an outer magnetic gap that is axially aligned with the inner magnetic gap.

In certain implementations, the cup section further includes a vent hole.

In particular aspects, the bobbin includes a set of vent holes including two or more vent holes.

In some cases, the set of vent holes include a plurality of circumferentially extending slots, each slot including a portion that circumferentially overlaps a neighboring, axially offset slot.

In certain aspects, the driver further includes a cone coupled with the bobbin and overlying the core section, where the set of vent holes mitigate the axial stiffness of the otherwise sealed cavity formed by the cone, bobbin, core, and ferrofluid.

In some particular implementations, the vent holes are slotted such that a mechanical resonance is introduced, primarily between the mass of the coil, the mass of the cone and the spring stiffness of the slotted vent holes. The slotted vent holes are designed such that during operation the resonance frequency is between approximately 5 kHz and approximately 12 kHz.

In some aspects, the wearable audio device includes an in-ear audio device.

In certain cases, the audio device further includes a surround over the core section, where the bobbin includes a set of vent holes, where the set of vent holes include a plurality of circumferentially extending slots, each slot including a portion that circumferentially overlaps a neighboring, axially offset slot, where the set of vent holes mitigate axial stiffness in the bobbin, and during operation of the driver, the set of holes introduce a mechanical resonance between the mass of the coil and the combined mass of the cone and the surround, where the bobbin consists essentially of a material having Young's modulus higher than approximately 2-4 giga-pascals (GPa) and the set of vent holes have a length-to-width ratio of at least approximately 12 to 15.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
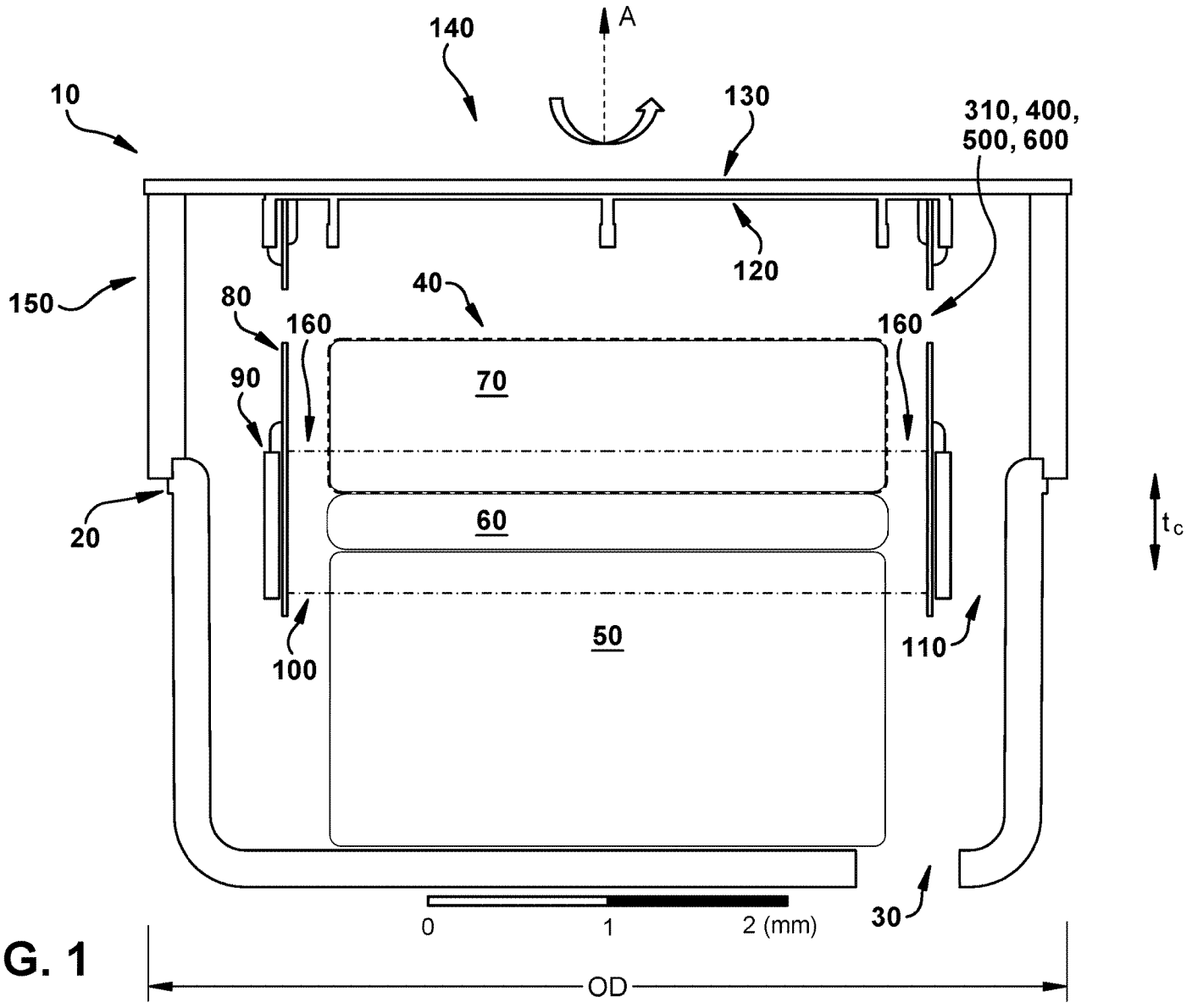
FIG. 1 is a cross-sectional view of an electro-acoustic driver according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that ferrofluid can be introduced in a miniature moving coil loudspeaker to provide increased stability. For example, a loudspeaker driver can include a ferrofluid at the inner magnetic gap for mitigating rocking of the driver cone.

Commonly labeled components in the FIGURES are considered to be substantially equivalent components for the purposes of illustration, and redundant discussion of those components is omitted for clarity. Numerical ranges and values described according to various implementations are merely examples of such ranges and values, and are not intended to be limiting of those implementations. In some cases, the term "approximately" is used to modify values, and in these cases, can refer to that value+/−a margin of error, such as a measurement error, which may range from 1 percent up to 5 percent in some cases.

FIG. 1 is a cross-sectional view of an electro-acoustic driver (or simply, "driver") 10 according to various implementations. In various implementations, the driver 10 is part of a wearable audio device, such as an on-ear or in-ear audio device. That is, in various implementations, the driver 10 is sized to fit within a wearable audio device casing that is intended to fit on the ear or in the ear of a user. In particular cases, the driver 10 is sized to fit within an in-ear audio device such as an earbud. In certain implementations, as illustrated in FIG. 1, the driver 10 has an outer diameter (OD) that is less than or equal to approximately 10 millimeters.

While components in the driver 10 of the various disclosed implementations are described in detail, certain components are only briefly described herein. An example additional driver configuration, in particular, for in-ear audio devices, is illustrated in U.S. Pat. No. 9,942,662 (Electro-acoustic driver having compliant diaphragm with stiffening element) and U.S. Pat. No. 9,628,903 (Microspeaker acoustical resistance assembly), as well as US Patent Application Publication No. 2017/0078800 (Fabricating an integrated loudspeaker piston and suspension), each of which is incorporated by reference herein in its entirety.

Returning to FIG. 1, the driver 10 is shown having a cup section 20 that includes a cup vent hole (or vent hole) 30, and at least partially houses a core section 40. In some implementations, the vent hole 30 is located proximate the core section 40. In certain cases, the core section 40 includes a primary magnet 50, and a coin 60 adjacent to the primary magnet 50. In some optional implementations, as illustrated in phantom in FIG. 1, the driver 10 includes a secondary magnet 70 located adjacent to the coin 60. In these cases, the coin 60 is positioned between the primary magnet 50 and the secondary magnet 70.

The driver 10 is also shown including a bobbin 80 according to various implementations. The bobbin 80 is illustrated surrounding the core section 40, between the cup section 20 and the core section 40. In various implementations, the driver 10 also includes a coil 90 surrounding the bobbin 80 and a portion of the core section 40. The coil 90 is configured to translate along the axis (A) during operation of the driver 10, e.g., to produce an acoustic output.

As illustrated in FIG. 1, in some cases, the bobbin 80 and the core section 40 define an inner magnetic gap 100. The inner magnetic gap 100 spans an axial distance along the coil 90 (with respect to axis A). Also shown in FIG. 1, the driver 10 includes an outer magnetic gap 110 defined by the coil 90 and the cup section 20. In various implementations, the outer magnetic gap 110 is axially aligned (along axis A) with the inner magnetic gap 100. That is, the outer magnetic gap 110 spans the same axial distance as the inner magnetic gap 100.

In certain cases, the driver 10 further includes a cone (or, diaphragm) 120 for outputting sound, along with a surround (or, suspension) 130 around the cone 120. The cone 120 is coupled with the bobbin 80 and overlies the core section 40. The cone 120 translates movement of the coil 90 into an acoustic output at the front 140 of the driver 10 (i.e., in front of the cone 120). The surround 130 is also shown connected with an adapter 150, e.g., a lead out adapter.

Figure 2:
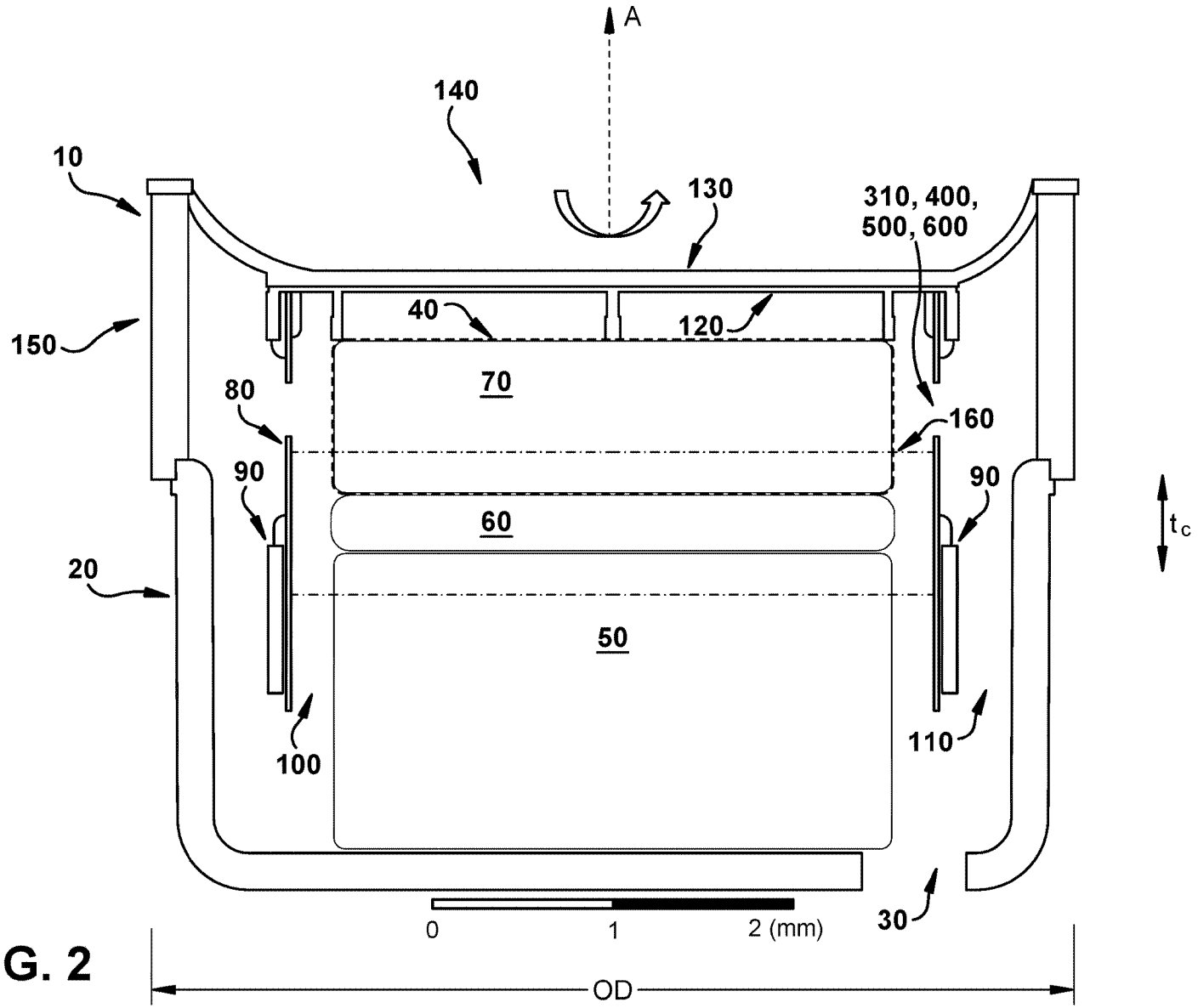
FIG. 2 shows the driver of FIG. 1 in a distinct position.

In various implementations, the driver 10 also includes a ferrofluid 160 located at the inner magnetic gap 100. In certain implementations, the ferrofluid 160 includes a colloidal liquid made of nanoscale ferromagnetic or ferrimagnetic particles suspended in a carrier fluid. The ferrofluid 160 is configured to respond to an external magnetic field, i.e., to be drawn to one or more nearby magnets such as the primary magnet 50, and in certain cases where the secondary magnet 70 is present, the primary and secondary magnets 50, 70. Example ferrofluids suitable for use in the driver 10 are available from the FerroTec Corporation of Bedford, N.H., and can include APG series ferrofluids such as APG 027N, APG 047N, APG L17, and APG compression driver series ferrofluids such as CD 1120, among others. The depiction of ferrofluid 160 in FIGS. 1 and 2 is understood to illustrate a general region in which that ferrofluid resides according to various implementations. While depicted generally within the inner magnetic gap 100, it is understood that this ferrofluid 160 may take any number of irregular shapes, including having surface contours. For example, during operation of the driver 10, magnetic forces and/or other forces may cause the ferrofluid 160 to shift within the region that is generally depicted in FIGS. 1 and 2. Additionally, as noted herein, different implementations may utilize different amounts of ferrofluid 160 at the inner magnetic gap 100.

While ferrofluids have conventional application in audio systems such as speakers, the scale of the driver 10 (with OD equal to or less than approximately 10 mm) makes conventional uses of ferrofluids impractical. Controlled application of small amounts of ferrofluid (e.g., several milligrams or less) can be particularly challenging. Additionally, use of bobbin wound coils for drivers of this scale (e.g., with OD approximately equal to or less than 10 mm) is also unconventional. In various implementations, the use of the bobbin 80 provides a well-defined surface upon which the ferrofluid 160 may ride.

In various example implementations, the ferrofluid 160 is dispersed in a controlled manner to limit the amount of ferrofluid 160 present at the inner magnetic gap 100. In some examples, the weight ratio of the coin 60 to the ferrofluid 160 is equal to approximately 2 to approximately 50. In certain additional examples, the ferrofluid 160 extends axially above and below the coin 60 by a distance equal to approximately a thickness ($t_c$) of the coin 60 times approximately 0 to approximately 1. In some examples, the volume of ferrofluid 160 in the inner magnetic gap 100 is equal to approximately the inner airgap radial dimension (measured from radially outer surface of coin 60 to radially inner surface of bobbin 80) multiplied by 1 to 3 times the axial thickness of the coin 60 (relative to axis A). In a particular example, the ferrofluid 160 weighs approximately 1-3 milligrams (mg). However, in other cases, such as where the coin 60 is larger in diameter, the ferrofluid 160 may have a greater weight.

In various implementations, the ferrofluid 160 fills the inner magnetic gap 100 and is retained within the inner magnetic gap 100 during operation of the driver 10. The ferrofluid 160 can beneficially mitigate rocking in the cone 120 (i.e., rocking about an axis in the cone plane) during operation of the driver 100. For example, the ferrofluid 160 can mitigate rocking in the cone 120 during operation of the driver 10 at frequencies ranging from approximately 200 hertz (Hz) to approximately 700 Hz, and in particular cases, at frequencies ranging from 200 Hz to approximately 400 Hz. In some implementations, during operation of the driver 10, the ferrofluid 160 adjusts a damping ratio of translational movement for the cone 120 along axis (A) as compared with a comparable driver without ferrofluid at the inner magnetic gap. In particular cases, during operation of the driver 10, the ferrofluid 160 increases the damping ratio of translational movement. In more particular cases, the ferrofluid 160 increases the damping ratio of translational movement to approximately 0.5 to approximately 1.0 times critical damping during operation of the driver 10. In certain implementations, the ferrofluid 160 dampens peak translational movement of the cone 120 (e.g., along axis (A)) at mechanical resonance, which yields a flat sensitivity curve for acoustic output.

Figure 3:
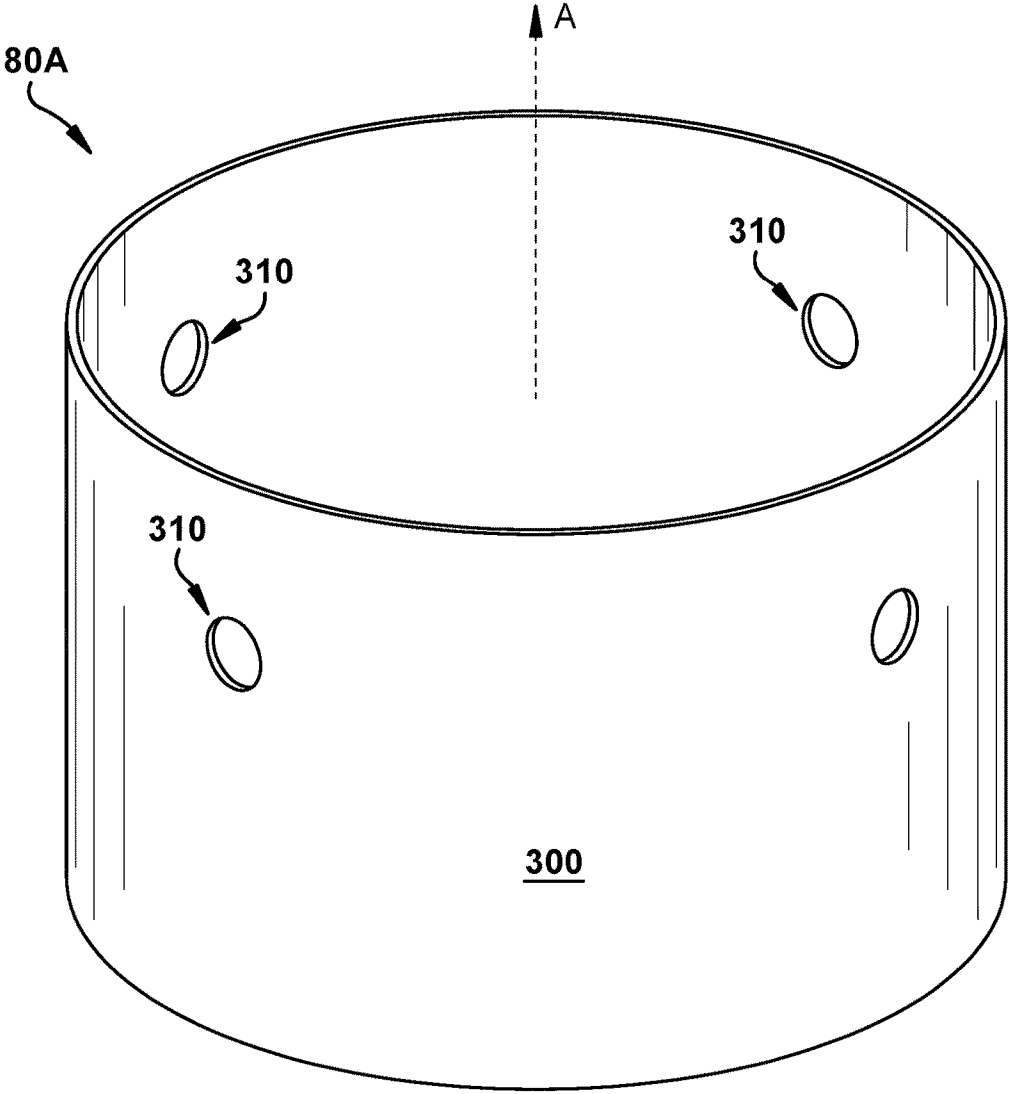
FIG. 3 shows a perspective view of a bobbin for the electro-acoustic driver of FIG. 1 according to various implementations.

FIGS. 3-6 show various bobbin configurations (e.g., bobbins 80) for a driver (e.g., driver 10) according to particular implementations. For example, FIG. 3 illustrates a first bobbin 80A with a body 300 having a set of radially extending vent holes 310. In some cases, the vent holes 310 have a circular cross-sectional shape, however, in other implementations the vent holes 310 are oval-shaped, oblong, rectangular, etc. As noted herein with respect to FIGS. 4-6, in various aspects, vent holes can take the form of circumferentially extending slots. In FIG. 3, the vent holes 310 are arranged circumferentially around the body 300 and permit airflow between the region proximate the inner magnetic gap 100 and the region proximate the outer magnetic gap 110.

Figure 4:
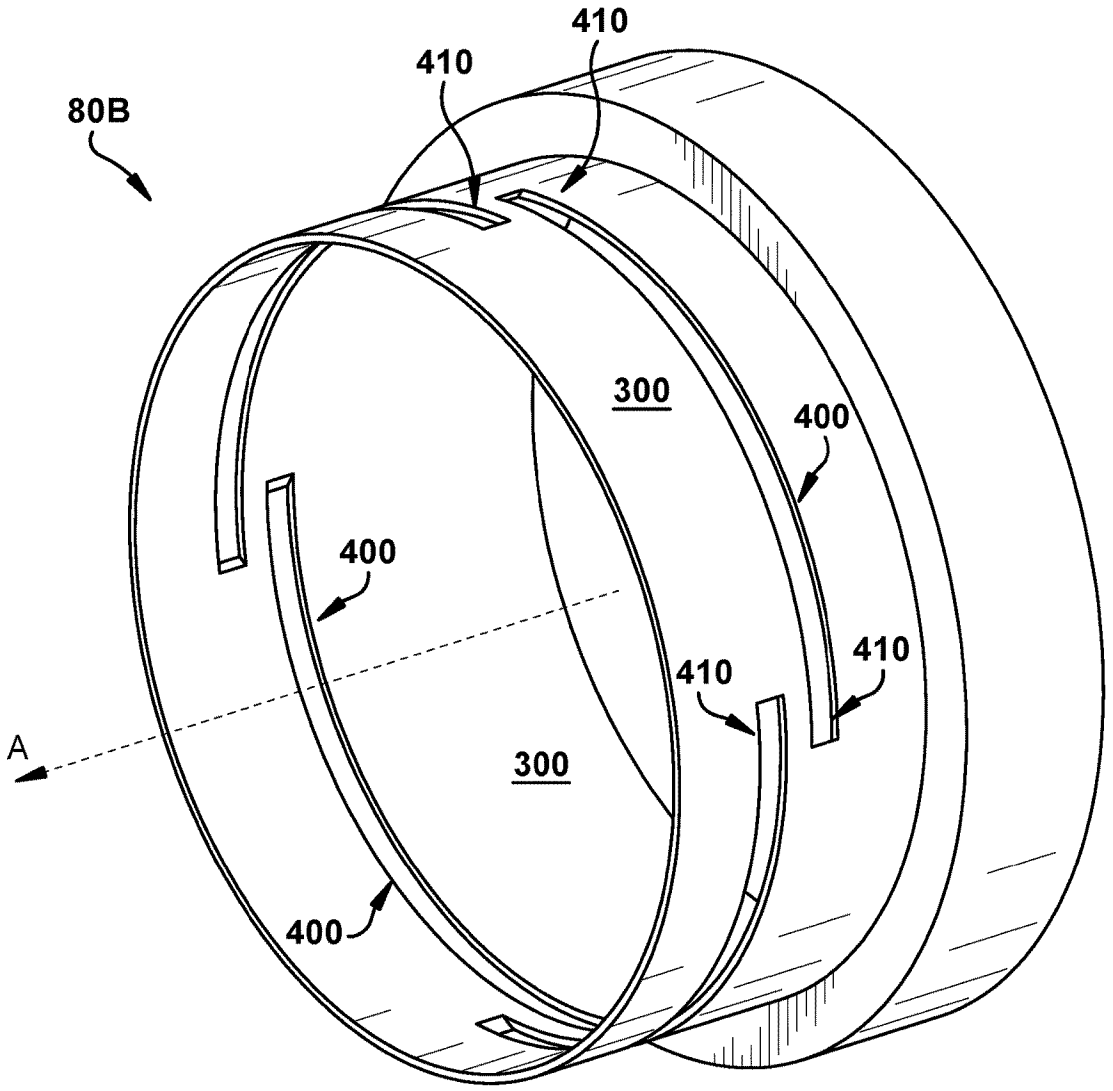
FIG. 4 shows a perspective view of a bobbin for the electro-acoustic driver of FIG. 1 according to various further implementations.
Figure 5:
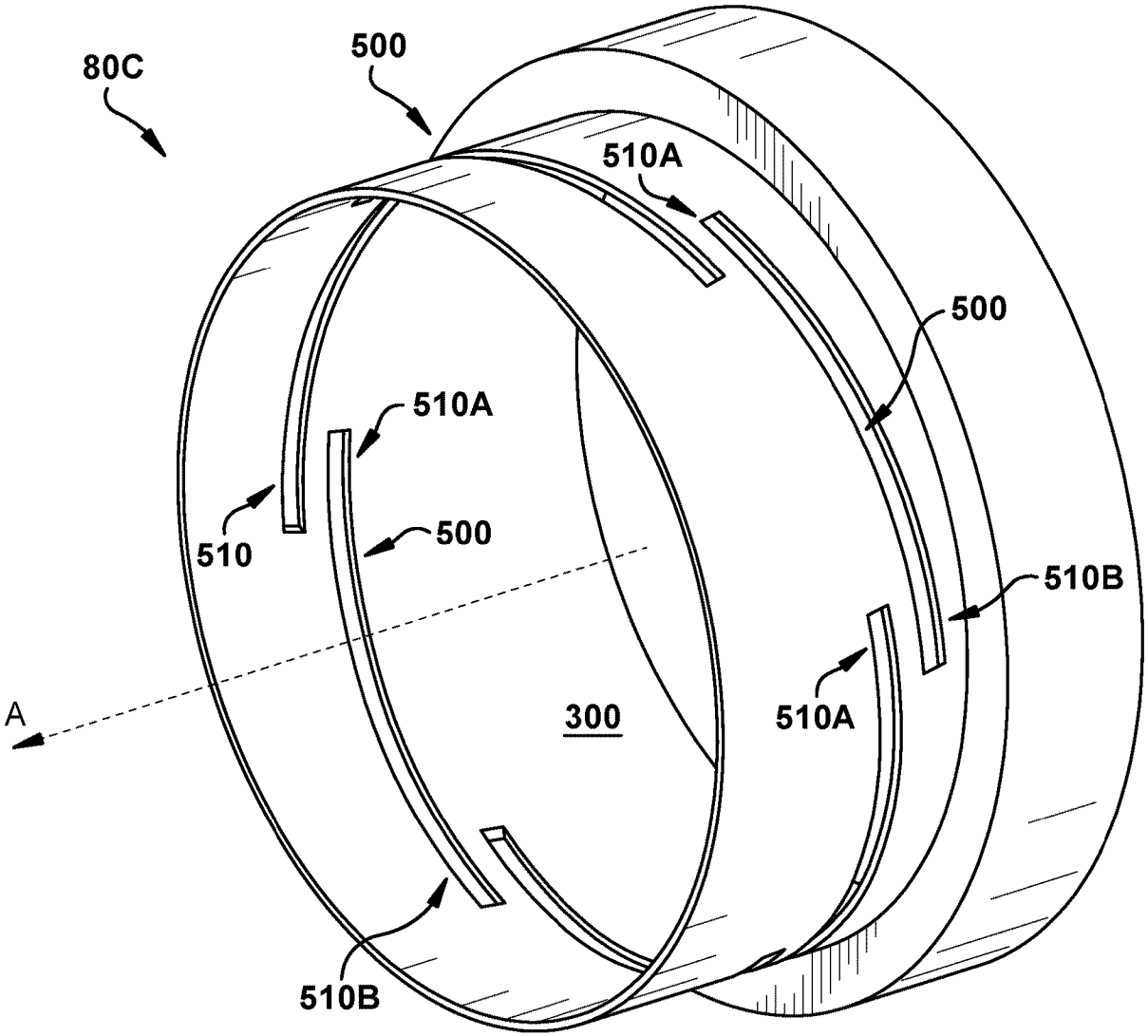
FIG. 5 shows a perspective view of a bobbin for the electro-acoustic driver of FIG. 1 according to various additional implementations.
Figure 6:
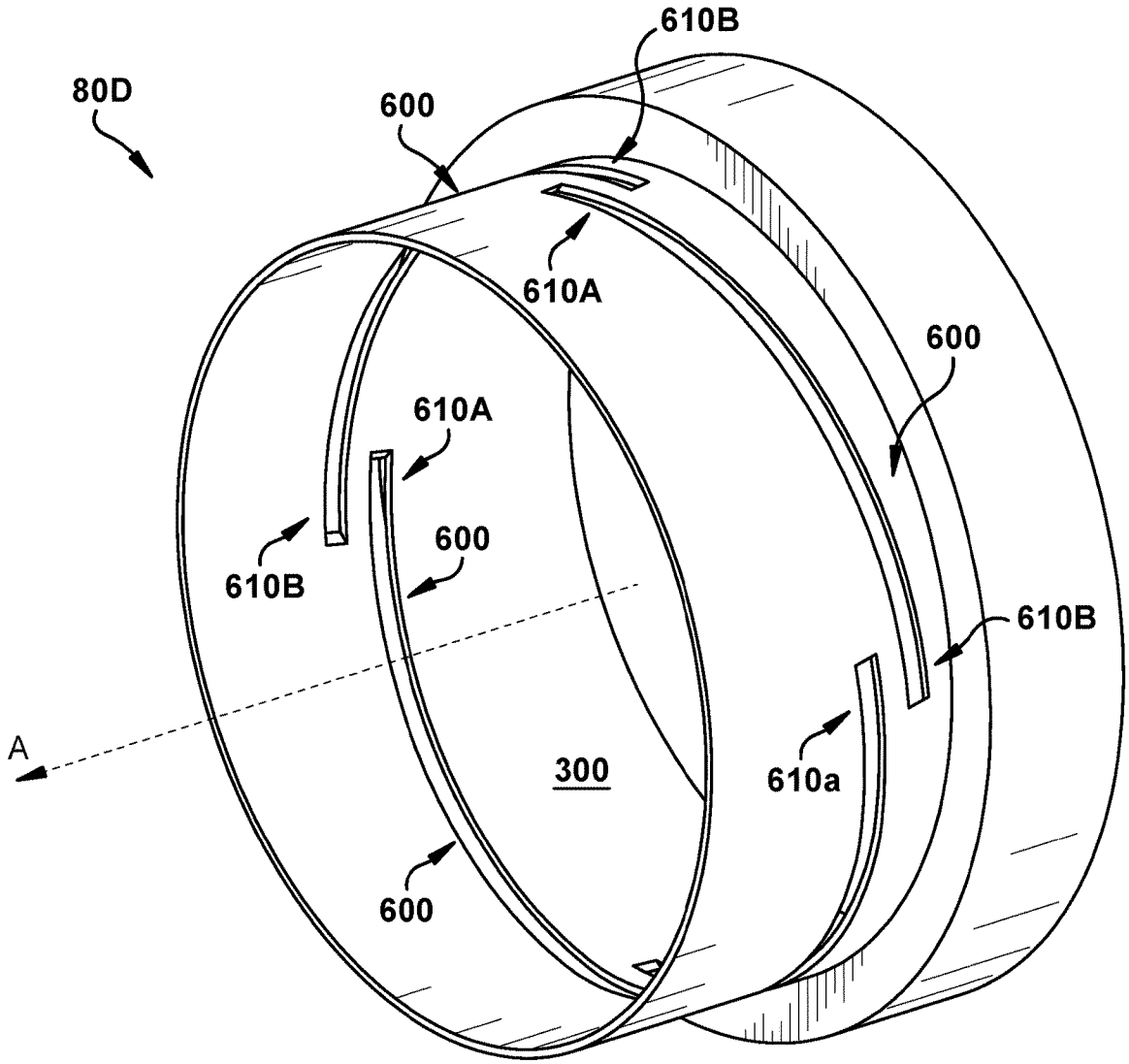
FIG. 6 shows a perspective view of a bobbin for the electro-acoustic driver of FIG. 1 according to various further implementations.

In particular implementations, as illustrated in the depictions of bobbins 80B, 80C and 80D in FIGS. 4-6, respectively, bobbins 80 can include a plurality of vent holes in the form of circumferentially extending slots. In particular, FIG. 4 shows bobbin 80B having a plurality of circumferentially extending slots 400 that each overlap a neighboring, axially offset slot 400. That is, each circumferentially extending slot 400 has a portion 410 that circumferentially overlaps a portion 410 of a neighboring, axially offset slot 400. In this sense, an axially extending line along the bobbin 80B that intersects one portion 410 of a slot 400 will intersect the circumferentially overlapping portion 410 of the neighboring slot 400. In the depiction in FIG. 4, the slots 400 extend approximately entirely circumferentially along the body 300. In these cases, each slot 400 is located at approximately the same axial position (along axis A) along its entire circumferential span, while each distinct slot 400 is located at a distinct axial position from each neighboring slot 400 along its entire circumferential span. In some particular cases, bobbin 80B includes four slots 400.

FIG. 5 shows bobbin 80C with circumferentially extending slots 500. In these cases, at least one of the slots 500 extends at least partially axially along the body 300. Similarly to bobbin 80B, each circumferentially extending slot 500 has a portion 510 that circumferentially overlaps a portion 510 of a neighboring, axially offset slot 500. In contrast to bobbin 80B, at least one of the circumferentially extending slots 500 in bobbin 80C extends at least partially axially, that is, portions 510A, 510B of the same slot 500 are located at distinct axial positions (A). In this sense, slots 500 extend at least partially helically around the body 300. In some particular cases, bobbin 80C includes six slots 500.

FIG. 6 shows bobbin 80D with circumferentially extending slots 600. In these cases, at least one of the slots 600 extends at least partially axially along the body 300. Similarly to bobbins 80B and 80C, each circumferentially extending slot 600 has a portion 610 that circumferentially overlaps a portion 610 of a neighboring, axially offset slot 600. In contrast to bobbin 80B, at least one of the circumferentially extending slots 600 in bobbin 80D extends at least partially axially, that is, portions 610A, 610B of the same slot 600 are located at distinct axial positions (A). In this sense, slots 600 extend at least partially helically around the body 300. In some particular cases, bobbin 80D includes four slots 600.

In various implementations, the vent holes (e.g., vent holes 310, slots 400, 500, 600) remove the axial stiffness of the otherwise sealed cavity formed by the cone 120, bobbin 80, core section 40, and ferrofluid 160. In various particular implementations, the vent holes described with reference to FIGS. 4-6 (e.g., slots 400, 500, 600) mitigate axial stiffness in the bobbin 80. In certain cases, during operation of the driver 10 (FIG. 1), the vent holes (e.g., slots 400, 500, 600) introduce a mechanical resonance between the mass of the coil 90 and the mass of the cone 120, and/or between the mass of the coil 90 and the combined mass of the cone 120 and the surround 130. In some cases, as noted herein, the vent holes (e.g., slots 400, 500, 600) are slotted such that a mechanical resonance is introduced, primarily between the mass of the coil 90, the mass of the cone 120 and the spring stiffness of the slotted vent holes. Without the vent holes (e.g., slots 400, 500, 600) illustrated according to various implementations, the mechanical resonance of a driver employing a bobbin could be undesirably high. However, as noted herein, the bobbins including vent holes (e.g., slots 400, 500, 600) can reduce that mechanical resonance and improve performance. For example, the vent holes (e.g., slots 400, 500, 600) can introduce mechanical resonance during operation of the driver 10 at a frequency between approximately 5 kilo-Hertz (kHz) and approximately 12 kHz (increasing driver 10 sensitivity in that frequency range). That is, the slotted vent holes (e.g., slots 400, 500, 600) are designed such that during operation, the resonance frequency is between approximately 5 kHz and approximately 12 kHz.

Figure 7:
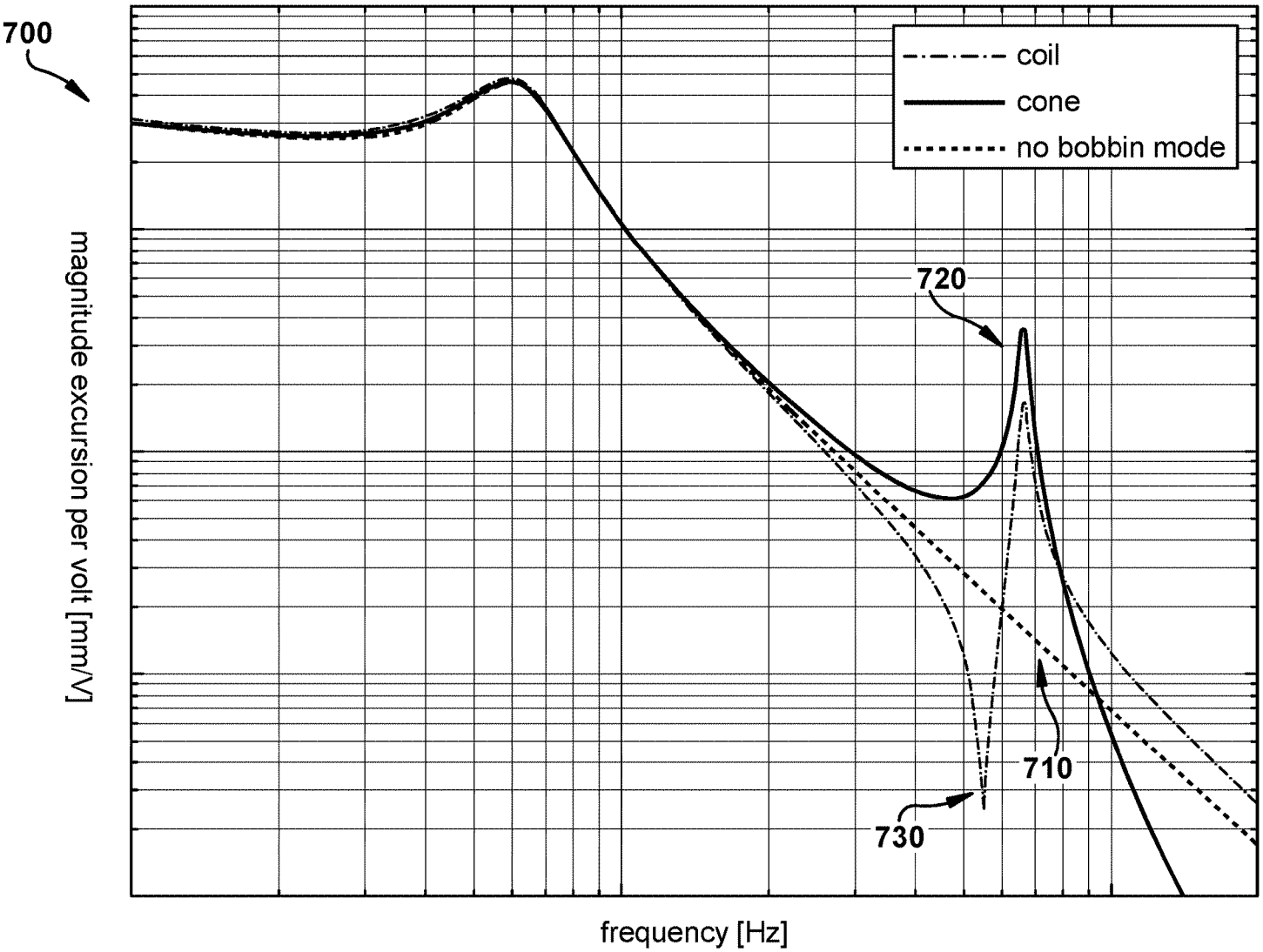
FIG. 7 is a graph illustrating the excursion of an example driver across a frequency range according to various implementations.

FIG. 7 is a graph 700 illustrating the excursion of an example driver across a frequency range according to various implementations. In particular, graph 700 plots the magnitude of excursion for a coil mass (e.g., coil 90, FIG. 1) and the remaining moving mass of the suspension (e.g., cone 120, FIG. 1) for a driver with a bobbin mode occurring between a defined frequency range (e.g., between approximately 5 kHz and 12 kHz, with a particular example illustrated at approximately 6 kHz to 7 kHz). The dashed line 710 illustrates a reference response where the coil and cone move together, that is, where the bobbin (e.g., bobbin 80, FIGS. 4-6) is stiff (also referred to as, "no bobbin mode"). Beneficially, at frequencies around the bobbin mode resonance, the excursion of the cone mass (indicated by solid line 720) is increased along with the acoustic output. Movement of coil mass is indicated by solid line 730.

Various bobbins 80 shown and described herein can consist essentially of a material having a Young's modulus higher than approximately 2-4 giga-pascals (GPa). Additionally, the circumferentially extending slots in bobbins 80B, 80C, 80D can have a length-to-width ratio of at least approximately 12 to 15.

As noted herein, the drivers disclosed according to various implementations can alleviate rocking in miniaturized moving coil loudspeakers. Additionally, these drivers can dampen mechanical resonance of axial motion in the loudspeaker. The drivers disclosed according to various implementations can provide enhanced performance and reliability when compared with conventional loudspeakers, particularly in small-scale audio devices.

One or more components in the driver(s) can be formed of any conventional loudspeaker material, e.g., a heavy plastic, metal (e.g., aluminum, or alloys such as alloys of aluminum), composite material, etc. It is understood that the relative proportions, sizes and shapes of the transducer(s) and components and features thereof as shown in the FIGURES included herein can be merely illustrative of such physical attributes of these components. That is, these proportions, shapes and sizes can be modified according to various implementations to fit a variety of products. For example, while a substantially circular-shaped driver may be shown according to particular implementations, it is understood that the driver could also take on other three-dimensional shapes in order to provide acoustic functions described herein.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

We claim:

1. An electro-acoustic driver comprising:
- a cup section;
- a core section at least partially housed in the cup section, the core section comprising:
  - a primary magnet; and
  - a coin adjacent to the primary magnet;
- a bobbin surrounding the core section between the cup section and the core section, wherein the bobbin and the core section define an inner magnetic gap;
- a coil surrounding the bobbin and a portion of the core section;
- a ferrofluid located at the inner magnetic gap; and
- a cone coupled with the bobbin and overlying the core section, the cone for translating movement of the coil into an acoustic output at a front of the driver,
- wherein the ferrofluid mitigates rocking in the cone during operation of the driver at a frequency range including: approximately 200 hertz (Hz) to approximately 700 Hz, and
- wherein the driver has an outer diameter less than or equal to approximately 10 millimeters.

2. The driver of claim 1, wherein the ferrofluid comprises a colloidal liquid, and, while the driver is at rest, the ferrofluid extends axially above and below the coin by a distance equal to approximately: a thickness of the coin multiplied by 0-1.

3. The driver of claim 1, wherein a weight ratio of the coin to the ferrofluid is equal to approximately 2 to approximately 50.

4. The driver of claim 1, wherein the coil translates along an axis during operation of the driver.

5. The driver of claim 1, further comprising a secondary magnet adjacent to the coin, wherein the coin is positioned between the primary magnet and the secondary magnet.

6. The driver of claim 1, wherein the inner magnetic gap spans an axial distance along the coil, wherein the ferrofluid fills the inner magnetic gap and is retained within the inner magnetic gap during operation of the driver.

7. The driver of claim 1, wherein the coil and the cup section define an outer magnetic gap that is axially aligned with the inner magnetic gap.

8. The driver of claim 1, wherein the cup section further comprises a vent hole.

9. The driver of claim 1, wherein the bobbin comprises a set of vent holes.

10. The driver of claim 9, wherein the set of vent holes comprise a plurality of circumferentially extending slots, each slot including a portion that circumferentially overlaps a neighboring, axially offset slot.

11. The driver of claim 9, further comprising a cone coupled with the bobbin and overlying the core section, wherein the set of vent holes mitigate axial stiffness in the bobbin, and during operation of the driver, the set of holes introduce a mechanical resonance between the mass of the coil and the mass of the cone, wherein the mechanical resonance is introduced during operation of the driver at a frequency between approximately 5 kHz and approximately 12 kHz.

12. An electro-acoustic driver comprising:

a cup section having a vent hole;

a core section at least partially housed in the cup section, the core section comprising:

a primary magnet; and a coin adjacent to the primary magnet, wherein the vent hole is located proximate the core section;

a bobbin surrounding the core section between the cup section and the core section, wherein the bobbin and the core section define an inner magnetic gap;

a coil surrounding the bobbin and a portion of the core section, wherein the inner magnetic gap spans an axial distance along the coil;

a ferrofluid located at the inner magnetic gap;

wherein a weight ratio of the coin to the ferrofluid is equal to approximately 2 to approximately 50; and a cone coupled with the bobbin and overlying the core section, the cone for translating movement of the coil into an acoustic output at a front of the driver, wherein the ferrofluid fills the inner magnetic gap and is retained within the inner magnetic gap during operation of the driver, and wherein the driver has an outer diameter less than or equal to approximately 10 millimeters.

13. The driver of claim 12, further comprising a secondary magnet adjacent to the coin, wherein the coin is positioned between the primary magnet and the secondary magnet, and wherein the ferrofluid extends axially above and below the coin by a distance equal to approximately: a thickness of the coin multiplied by 0-1, and mitigates rocking in the cone.

14. The driver of claim 13, wherein the bobbin comprises a set of vent holes, wherein the set of vent holes comprise a plurality of circumferentially extending slots, each slot including a portion that circumferentially overlaps a neighboring, axially offset slot, wherein the set of vent holes mitigate axial stiffness in the bobbin, and during operation of the driver, the set of holes introduce a mechanical resonance between the mass of the coil and the mass of the cone, wherein the mechanical resonance is introduced during operation of the driver at a frequency between approximately 5 kHz and approximately 12 kHz, wherein the ferrofluid adjusts a damping ratio of translational movement for the cone to approximately 0.5 to approximately 1.0 times critical damping during operation of the driver.

15. An electro-acoustic driver comprising:

a cup section;

a core section at least partially housed in the cup section, the core section comprising:

a primary magnet; and a coin adjacent to the primary magnet;

a bobbin surrounding the core section between the cup section and the core section, wherein the bobbin and the core section define an inner magnetic gap;

a coil surrounding the bobbin and a portion of the core section;

a ferrofluid located at the inner magnetic gap; and a cone coupled with the bobbin and overlying the core section, the cone for translating movement of the coil into an acoustic output at a front of the driver, wherein the ferrofluid adjusts a damping ratio of translational movement for the cone to approximately 0.5 to approximately 1.0 times critical damping during operation of the driver, and wherein the ferrofluid dampens peak movement of the cone at mechanical resonance, and wherein the driver has an outer diameter less than or equal to approximately 10 millimeters.

16. The driver of claim 15, wherein the ferrofluid mitigates rocking in the cone during operation of the driver at a frequency range including: approximately 200 hertz (Hz) to approximately 700 Hz.

17. The driver of claim 15, wherein the cup section further comprises a vent hole.

18. An electro-acoustic driver comprising:

a cup section;

a core section at least partially housed in the cup section, the core section comprising:

a primary magnet;

a coin adjacent to the primary magnet; and a secondary magnet adjacent to the coin, wherein the coin is positioned between the primary magnet and the secondary magnet;

a bobbin surrounding the core section between the cup section and the core section, wherein the bobbin and the core section define an inner magnetic gap;

a coil surrounding the bobbin and a portion of the core section; and a ferrofluid located at the inner magnetic gap, wherein the driver has an outer diameter less than or equal to approximately 10 millimeters.

19. The driver of claim 18, wherein a weight ratio of the coin to the ferrofluid is equal to approximately 2 to approximately 50.

20. The driver of claim 18, wherein the coil translates along an axis during operation of the driver.

* * * * *